US005574335A

United States Patent [19]

Sun

[11] Patent Number: 5,574,335

[45] Date of Patent: * Nov. 12, 1996

[54] BALLAST CONTAINING PROTECTION CIRCUIT FOR DETECTING RECTIFICATION OF ARC DISCHARGE LAMP

[75] Inventor: Yiyoung Sun, Danvers, Mass.

[73] Assignee: Osram Sylvania Inc., Danvers, Mass.

[ * ] Notice: The term of this patent shall not extend beyond the expiration date of Pat. No. 5,475,284.

[21] Appl. No.: 284,779

[22] Filed: Aug. 2, 1994

[51] Int. Cl.[6] ..... H05B 37/00

[52] U.S. Cl. ..... 315/119; 315/307; 315/121; 315/DIG. 5

[58] Field of Search ..... 315/224, 307, 315/DIG. 7, 209 R, 225, DIG. 5, 119, 121, 122, 219, 107

[56] References Cited

U.S. PATENT DOCUMENTS

| | | | |
|---|---|---|---|
| 4,503,363 | 3/1985 | Nilssen | 315/225 |
| 5,023,516 | 6/1991 | Ito et al. | 315/101 |
| 5,111,114 | 5/1992 | Wang | 315/225 |
| 5,138,235 | 8/1992 | Sun et al. | 315/209 R |
| 5,142,202 | 8/1992 | Sun et al. | 315/225 |
| 5,262,699 | 11/1993 | Sun et al. | 315/209 R |

FOREIGN PATENT DOCUMENTS 0056481 7/1982 European Pat. Off. .

*Primary Examiner*—Robert J. Pascal
*Assistant Examiner*—David Vu
*Attorney, Agent, or Firm*—Carlo S. Bessone

[57] ABSTRACT

A ballast includes an inverter for providing an AC voltage to a discharge lamp. As the lamp approaches end-of-life, a DC voltage component develops across the lamp. The ballast includes circuitry for monitoring the condition of each of the cathodes by measuring this DC voltage component. After a predetermined increase in this DC voltage component, the inverter is disabled in order to prevent excessive heating of the cathodes. The inverter is also disabled as a result of a resonant or near resonant mode condition of a tank circuit caused by an open circuit condition or a leaking lamp.

10 Claims, 2 Drawing Sheets

BALLAST CONTAINING PROTECTION CIRCUIT FOR DETECTING RECTIFICATION OF ARC DISCHARGE LAMP

CROSS-REFERENCE TO RELATED APPLICATIONS

This application discloses and claims structural features for a protection circuit for arc discharge lamps which constitutes improvements over related subject matter disclosed and claimed in U.S. Ser. No. 08/237,465 of James L. Lester et al filed May 3, 1994 and assigned to the assignee of the present application.

FIELD OF THE INVENTION

This invention relates to arc discharge lamps, particularly fluorescent miniature and compact fluorescent lamps, and especially to electronic ballasts containing circuitry for protecting the lamp from overheating at end-of-life and for protecting the ballast from component failure.

BACKGROUND OF THE INVENTION

Low-pressure arc discharge lamps, such as fluorescent lamps, are well known in the art and typically include a pair of cathodes made of a coil of tungsten wire upon which is deposited a coating of an electron-emissive material consisting of alkaline metal oxides (i.e., BaO, CaO, SrO) to lower the work function of the cathode and thus improve lamp efficiency. With electron-emissive material disposed on the cathode filament, the cathode fall voltage is typically about 10 to 15 volts. However, at the end of the useful life of the lamp when the electron-emissive material on one of the cathode filaments becomes depleted, the cathode fall voltage quickly increases by 100 volts or more. If the external circuitry fails to limit the power delivered to the lamp, the lamp may continue to operate with additional power being deposited at the lamp cathode region. By way of example, a lamp which normally operates at 0.1 amp would consume 1 to 2 watts at each cathode during normal operation. At end-of-life, the depleted cathode may consume as much as 20 watts due to the increase in cathode fall voltage. This extra power can lead to excessive local heating of the lamp and fixture.

Small diameter (e.g., T2 or ¼ inch) fluorescent lamps generally have very high ignition voltage requirements necessitating the use of ballasts with open circuit output voltages which may exceed 1000 volts. Such voltage levels are enough to sustain a conducting lamp with an arc drop of 50 to 150 volts with a depleted cathode and an end-of-life cathode fall voltage of 200 volts. In this example, the lamp would run at nearly rated current because the excess voltage would be mostly dropped across the output impedance of the ballast. Since the cathodes in these small diameter T2 lamps are placed much closer to the internal tube wall than in larger diameter lamps, less cathode power is needed to overheat the glass in the area of the cathode. In such T2 diameter lamps, it would be desirable to limit the increase in cathode power to about 4 watts in order to avoid excessive local heating.

Various attempts have been made to provide over-voltage or over-current protection in inverter-type ballasts in order to prevent circuit damage due to excessive load power. For example, U.S. Pat. No. 5,262,699, which issued to Sun et al on Nov. 16, 1993, describes an inverter-type ballast having means for detecting a relatively large increase in current resulting from a resonant mode or open circuit (i.e. no load) condition. The inverter is disabled whenever the lamp is removed or if the lamp fails to ignite. Depletion of emissive material on one or more of the lamp electrodes, which prevents the lamp from igniting, will cause such an open circuit condition.

U.S. Pat. No. 4,503,363, which issued to Nilssen on Mar. 5, 1985, describes an inverter-type ballast having a subassembly which senses the voltage across the output of the ballast. When an open circuit condition is detected at the input of the subassembly, resulting from the removal of a lamp from one of its sockets or the failure of a lamp to ignite, the inverter is disabled.

While the disabling circuits of U.S. Pat. Nos. 5,262,699 and 4,503,363 may be effective at disabling the inverter upon detection of a relatively large increase in current or voltage, these circuits are ineffective at responding to relatively small increases in cathode fall power.

"Quicktronic" inverter ballasts manufactured by OSRAM GmbH for operating "Dulux DE" compact fluorescent lamps monitor an increase in ballast input power by sensing supply voltage which is boosted with RF feedback from the lamp. Effectively, lamp voltage is sensed since lamp current is somewhat constant in the ballast over the sense range. An increase in input power of about 6 to 10 watts with a ±2 watt tolerance is required to disable the inverter. Due to the drawbacks of voltage sensing as discussed above, this approach is best suited for sensing very large voltage increases such as a lamp no start or open circuit load condition. Moreover, this approach requires tight control of circuit component tolerances which adds to cost and reduces load flexibility.

SUMMARY OF THE INVENTION

It is, therefore, an object of the present invention to obviate the disadvantages of the prior art.

It is another object of the invention to provide an inverter disabling circuit which provides lamp and circuit component protection at end-of-life following a small increase in lamp voltage resulting from a relatively small increase in cathode power.

These objects are accomplished in one aspect of the invention by the provision of a ballast for a discharge lamp having a pair of cathodes wherein the discharge lamp is characterized by a lamp voltage waveform having a DC voltage component when the lamp approaches end-of-life upon depletion of emissive material on one of the cathodes. The ballast comprises a pair of AC input terminals adapted to receive an AC signal from an AC power supply and a DC power supply coupled to the AC input terminals. An inverter is coupled to the DC power supply. A load comprising a tank circuit having a near-resonant mode condition and a resonant mode condition is coupled to the output of the inverter. A first detector has an input adaptable for coupling to the discharge lamp for detecting an increase in the DC voltage component. A disabling circuit is coupled to the output of the first detector for disabling the inverter in response to at least the increase in the DC component.

In accordance with further teachings of the present invention, the tank circuit includes a magnetic component having an inductive tank winding. Preferably, the ballast further includes a second detector having an input coupled to the magnetic component for detecting at least the resonant mode condition of the tank circuit. In the preferred embodiment, the second detector is adapted to detect a near-resonant mode condition.

Additional objects, advantages and novel features of the invention will be set forth in the description which follows, and in part will become apparent to those skilled in the art upon examination of the following or may be learned by practice of the invention. The aforementioned objects and advantages of the invention may be realized and attained by means of the instrumentalities and combination particularly pointed out in the appended claims.

BRIEF DESCRIPTION OF THE DRAWINGS

The invention will become more readily apparent from the following exemplary description in connection with the accompanying drawings, wherein.

BEST MODE FOR CARRYING OUT THE INVENTION

For a better understanding of the present invention, together with other and further objects, advantages and capabilities thereof, reference is made to the following disclosure and appended claims in connection with the above-described drawings.

Figure 1:
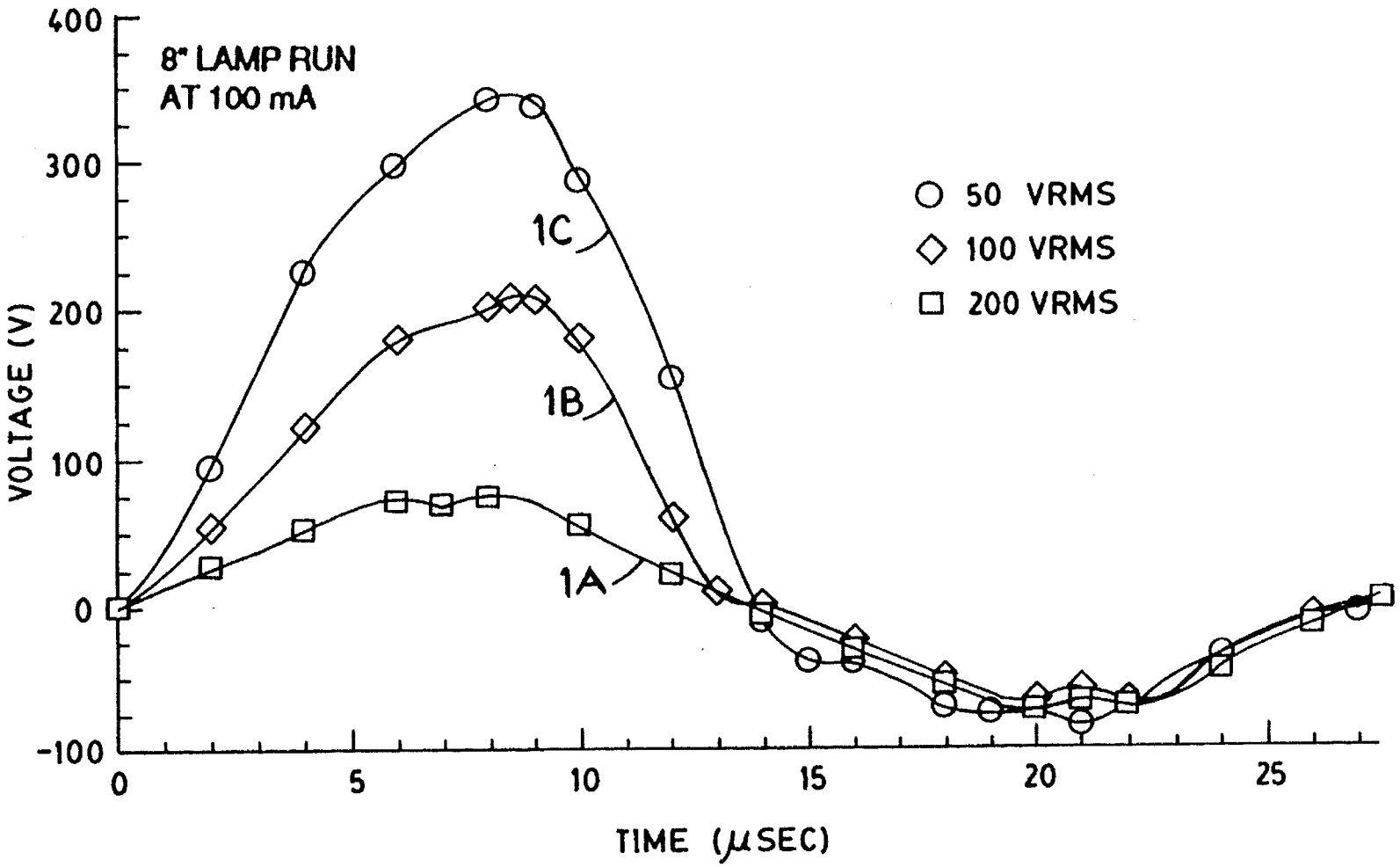
FIG. 1 is a plot of lamp voltage as a function of time showing the introduction of a DC component to the lamp voltage waveform as one lamp cathode wears out.

FIG. 1 is a plot of lamp voltage as a function of time for one cycle showing the introduction of a DC component to the lamp voltage waveform as one lamp cathode wears out. In a normally operating arc discharge lamp, as indicated by the waveform 1A having an RMS lamp voltage of 50 volts, the cathode fall voltages of each cathode are equal. Since the current waveform driving the lamp, in this example, is symmetrical around the zero axis, the lamp voltage will contain an AC component and no DC component. As the lamp approaches end-of-life when the electron-emissive material on one of the electrode filaments becomes depleted, the lamp will appear to partially rectify and a DC component will be added to the total lamp voltage as indicated by waveforms 1B and 1C. Due to an increase in cathode fall voltage, the power consumed by the depleted cathode increases and may lead to excessive local heating of the lamp and fixture if not limited.

It should be noted that a depletion of emissive material on the opposite cathode would also be indicated by the addition of a DC component (of opposite polarity) but with a negative increase in the peak voltage appearing in the second half of the lamp voltage waveform.

In T2 (i.e., ¼ inch) diameter lamps, it would be desirable to limit the increase in cathode power to a maximum of about 4 watts in order to avoid any excessive local heating. For a larger diameter lamp, the allowable increase in cathode power may be adjusted accordingly. In the present example, a 4 watt increase in cathode fall power corresponds to a change in overall DC lamp voltage from zero volts to about 52 volts. The present invention monitors the condition of each lamp electrode by sensing the DC component in the lamp's voltage waveform independent of the AC component.

Figure 2:
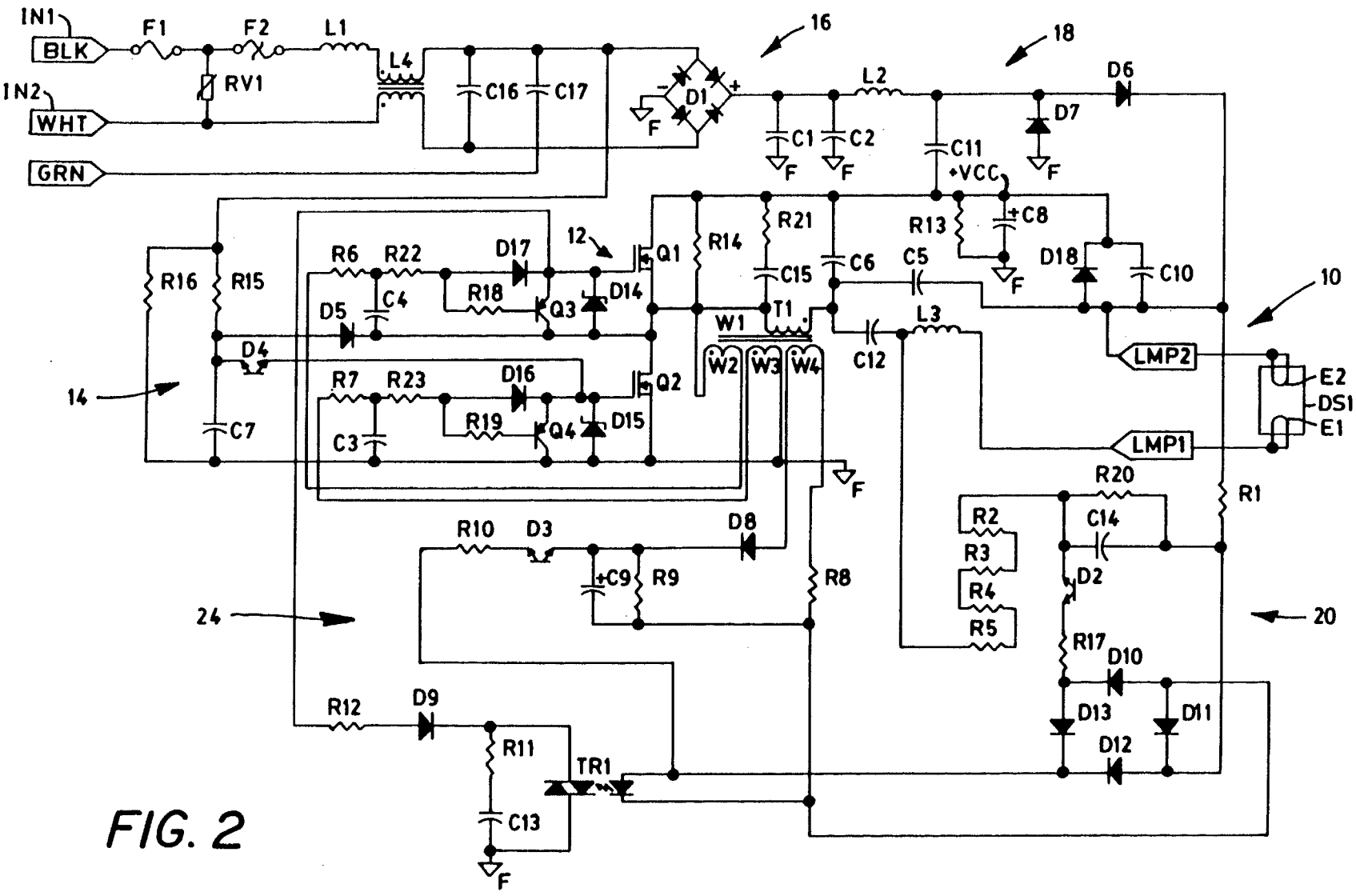
FIG. 2 a schematic diagram of one embodiment of a ballast for an arc discharge lamp in accordance with the present invention.

FIG. 2 represents a schematic diagram of a preferred embodiment of a ballast for a discharge lamp DS1. Lamp DS1 is an arc discharge lamp such as a low-pressure fluorescent lamp having a pair of opposing cathodes such as filamentary cathodes E1, E2. Each of the filamentary cathodes is coated during manufacturing with a quantity of emissive material. Lamp DS1, which forms part of a load circuit 10, is ignited and fed via an oscillator or inverter 12 which operates as a DC/AC converter. Inverter 12 receives filtered DC power from a DC power supply 16 which is coupled to a source of AC power. Conduction of inverter 12 is initiated by a starting circuit 14. The ballast may include a network 18 or an equivalent for correcting the power factor. In order to prevent excessive heating of the cathodes, circuit 20 temporarily disables the inverter upon detection of a lamp which is approaching the end of its useful life and is beginning to rectify. A circuit 24 monitors AC output voltage and detects an abnormal increase in AC load voltage caused by a resonant mode condition or a near-resonant mode condition. Upon detection of a resonant mode condition caused, for example, by a completely failed lamp (i.e., no lamp current) or a removed lamp, the inverter will be temporarily disabled. Circuit 24 will also sense a leaking lamp which produces a near-resonant mode condition and causes the AC load current to gradually increase.

In FIG. 2, a pair of input terminals IN1, IN2 are connected to an AC power supply such as 108 to 132 volts, 60 Hz. A fuse F1 and a varistor RV1 are connected in series across input terminals IN1, IN2 in order to provide over current and line voltage transient protection, respectively. Thermal protection is provided by a thermal breaker F2. An electromagnetic interference filter consisting of an inductor L1, a common mode choke L4 and a pair of capacitors C16 and C17 is connected in series with input terminals IN1, IN2 and the input of a DC power supply 16.

DC power supply 16 is of conventional design and consists of a bridge rectifier D1, capacitor C8 and a resistor R13. The output of DC power supply 16 is shown in FIG. 2 as terminal +VCC. The output of bridge rectifier D1 may be connected to a power factor correction network 18 comprising an inductor L2, capacitors C1, C2, C5, C6, C10 and C11, and diodes D6, D7 and D18.

Inverter 12, which includes (as primary operating components) a pair of series-coupled semiconductor switches, such as MOSFETs Q1 and Q2 or suitable bipolar transistors (not shown), is coupled in parallel with DC output terminal +VCC and ground of DC power supply 16. Base drive and switching control for MOSFETs Q1 and Q2 are provided by secondary windings W2 and W3 of a transformer T1. The inductance of transformer T1 influences the switching frequency of MOSFETs Q1 and Q2. Typically, the transistor switching frequency of inverter 12 is from about 30 Khz to 70 Khz.

Inverter starting circuit 14 includes a series arrangement of a resistor R15 and a capacitor C7. The junction point between resistor R15 and capacitor C7 is connected to a one end of a bi-directional threshold element D4 (i.e., a diac). The other end of threshold element D4 is coupled to the gate or input terminal of MOSFET Q2. During normal lamp operation, inverter starting circuit 14 is rendered inoperable due to a diode rectifier D5 by holding the voltage across starting capacitor C7 at a level which is lower than the threshold voltage of threshold element D4.

A pair of zener diodes D14 and D15 protect the gate of MOSFETs Q1 and Q2, respectively, from overvoltage. An arrangement consisting of a transistor Q3, a diode D17 and a resistor R18 improves turnoff of MOSFET Q1. A similar arrangement consisting of a transistor Q4, a diode D16 and a resistor R19 improves turnoff of MOSFET Q2. A phase shift network consisting of resistors R6 and R22 and a capacitor C4 is coupled to the input of MOSFET Q1. In a similar manner, the input of MOSFET Q2 is coupled to a phase shift network consisting of resistors R7 and R23 and a capacitor C3.

A load circuit 10 includes a primary winding W1 of transformer T1 and capacitors C5 and C6. Primary winding W1 comprises the principle ballasting element for the lamp. The other end of capacitor C5 is connected to terminal LMP2 of lamp DS1. In order to effectively limit peak lamp current during initial startup caused by the discharging of capacitors C5 and C6, an inductor L3 is connected in series with lamp DS1. A capacitor C12 blocks any DC component.

The electrodes El, E2 of discharge lamp DS1 may be coupled to the ballast either in a permanent manner or by means of suitable sockets in order to facilitate lamp replacement. Although FIG. 2 illustrates an instant-start discharge lamp wherein the lead-in wires from each cathode are shown shorted together and coupled to respective terminals LMP1, LMP2, other coupling arrangements are possible.

In the embodiment illustrated in FIG. 2, a circuit 20 for detecting a DC voltage across lamp DS1 includes a RC integration network comprising resistors R1, R20, R2, R3, R4 and R5, and a capacitor C14 in parallel with resistor R20 coupled in parallel with lamp DS1. This RC integration network and the switching current of D2 provide for voltage division to set the trip level of the sensed DC voltage. One end of capacitor C14 is connected to a series combination of a threshold element D2 and a resistor R17. One end of resistor R17 is connected to a full wave bridge rectifier network consisting of diodes D10, D11, D12 and D13.

The power increase in a depleted cathode is directly proportional to the magnitude of the DC voltage across the lamp measured by DC voltage sensing circuit 20. Since either polarity of DC voltage is monitored by the sensing and disabling circuit due, in part, to the full wave bridge rectifier, failure of either cathode causes the inverter to be disabled. The polarity of the DC voltage across lamp DS1 (and capacitor C14) depends upon the cathode that becomes depleted of emissive material.

The output of circuit 20 is connected to a LED at the input of an optical isolator TR1. A snubber network consisting of a resistor R11 and a capacitor C13 shunts the output triac of optical isolator TR1. Conduction of the triac of optical isolator TR1 shunts gate drive current from MOSFET Q1 to ground through a resistor R12 and a diode D9. As a result, inverter 12 is temporarily disabled.

In FIG. 2, a circuit 24 senses a resonant mode condition of capacitors C5, C6, C10 and the inductance of winding W1. Circuit 24 is connected to a third secondary or sensing winding W4 on transformer T1. The AC voltage across sensing winding W4 is proportional to the AC voltage across lamp DS1. As shown, one end of sensing winding W4 is coupled through a diode D8 to a capacitor C9 which is shunted by a discharge resistor R9. The positive terminal of capacitor C9 is coupled through a diac D3 and a resistor R10 to the LED input of optical isolator TR1.

The semiconductor switches may be driven by a means other than an inverter drive transformer. For example, the semiconductor switches may be driven directly by control logic circuitry. In this instance, the inverter drive transformer is replaced by another magnetic component such as an inductor having a single sensing winding.

The operation of the ballast will now be discussed in more detail. When terminals IN1 and IN2 are connected to a suitable AC power source, DC power source 16 rectifies and filters the AC signal and develops a DC voltage across capacitor C8. Simultaneously, starting capacitor C7 in inverter starting circuit 14 begins to charge through resistor R15 to a voltage which is substantially equal to the threshold voltage of threshold element D4. Upon reaching the threshold voltage (e.g., 32 volts), the threshold element breaks down and supplies a pulse to the gate or input of MOSFET Q2. As a result, current from the DC supply flows through capacitors C10, C5 and C6, the primary winding W1 of transformer T1 and MOSFET Q2. Since the lamp is essentially an open circuit during starting, no current flows through the lamp at this time. This initial current flowing through primary winding W1 causes a voltage developed across winding W3, the polarity of which enforces the turn-on of MOSFET Q2 through the phase shift network comprising resistors R7 and R23 and capacitor C3. The voltage across winding W3 rings at the frequency determined by the LC tank circuit. When this voltage drops below the threshold of MOSFET Q2, Q2 turns off and MOSFET Q1 starts to turn on due to the fact that windings W2 and W3 are in one transformer with opposite polarity. This process is repeated causing a high voltage to be developed across capacitor C5 (and lamp DS1) as a result of a series resonant circuit formed by capacitor C5 and the primary winding W1. The high voltage developed across capacitor C5 is sufficient to ignite lamp DS1.

At the end of the useful life of the lamp when the electron-emissive material on one of the cathode filaments becomes depleted, the lamp will partially rectify and a DC voltage component will develop across capacitor C14 in circuit 20. When the voltage developed across capacitor C14 exceeds the threshold voltage of element D2, capacitor C14 discharges through resistor R17, diodes D13 and D11 (or diodes D10 and D12, depending upon the polarity across capacitor C14) and the LED of optical isolator TR1.

Detecting circuit 24 detects, for example, if a lamp does not light (i.e., no lamp current), if the lamp is removed from the circuit, or is the lamp is leaking. Under such conditions, the ballast will run in a series resonant mode or near series resonant condition with capacitors C5, C6 and C10 and the inductance of winding W1. By the nature of a series resonant circuit, the combined impedance of these resonant elements will be zero and the only noticeable impedance in the circuit is the winding resistances of winding W1 and the drain-source resistance of MOSFETs Q1 and Q2. In the above situations, the lamp voltage and the Q of the tank circuit increase. Consequently, the voltage developed across capacitor C9 will exceed the threshold voltage of element D3 and will discharge through resistor R10 and the LED of optical isolator TR1.

When the LED of optical isolator TR1 conducts as a result of either one of the sensing circuits 20 or 24, optical isolator TR1 is triggered causing shunting of the triac at the output and coupling of the gate of MOSFET Q1 to ground. Because of the limited voltage available at the gate of MOSFET Q1, the gate drive voltage will be insufficient to turn on Q1, causing an interruption in operation of the inverter. With the ballast is shut down, no signal is supplied to capacitors C14 and C9 which begin to discharge through resistors R20 and R9, respectively. The triac of TR1 remains shunted maintaining Q1 biased off and the ballast in a shutdown state.

After power to the ballast is disconnected, the voltage across capacitor C8 begins to discharge through discharge resistor R13. The circuit is reset and conduction of MOSFETs Q1 and Q2 is restarted by reconnecting power to the ballast after allowing the voltage across capacitor C8 to drop sufficiently that the holding current level of TR1's output triac is not maintained.

The choice of detecting a resonant mode condition or a near-resonant mode condition is determined by the proper selection of resistors R8 and R9. If circuit 24 is adjusted to sense a near-resonant mode condition, a resonant mode condition will automatically be sensed also. However, the opposite is not always true.

It is well within the scope of the invention to modify circuits 20 and 24 for example, with a non-latching optical isolator, so that it would not be necessary to disconnect power to the ballast in order to reset the shut down circuits or with a SCR optical isolator which may have two separate inputs. Moreover, even though only one lamp is shown, it is within the scope of the invention to include any suitable number of lamps.

As a specific example but in no way to be construed as a limitation, the following components are appropriate to the embodiment of the present disclosure, as illustrated by FIG. 2:

| Item | Type | Schematic Value |
|---|---|---|
| C1, C2 | Capacitors | 0.33 MFD |
| C3, C4 | Capacitors | 1500 PFD |
| C5 | Capacitor | 3300 PFD |
| C6 | Capacitor | 1800 PFD |
| C7 | Capacitor | 0.1 MFD |
| C8 | Capacitor | 47 MFD |
| C9 | Capacitor | 22 MFD |
| C10 | Capacitor | 4700 PFD |
| C11 | Capacitor | 2200 PFD |
| C12 | Capacitor | 0.01 MFD |
| C13 | Capacitor | 0.022 MFD |
| C14 | Capacitor | 4.7 MFD |
| C15 | Capacitor | 1000 PFD |
| C16 | Capacitor | 0.01 MFD |
| C17 | Capacitor | 2200 PFD |
| R1-R5 | Resistors | 100K ohm |
| R6, R7 | Resistors | 2.1K ohm |
| R8 | Resistor | 11K ohm |
| R9 | Resistor | 62K ohm |
| R10, R17, R21 | Resistors | 10 ohm |
| R11 | Resistor | 200 ohm |
| R12 | Resistor | 6.8K ohm |
| R13, R16 | Resistors | 360K ohm |
| R14 | Resistor | 270 K ohm |
| R15 | Resistor | 470 K ohm |
| R18, R19 | Resistors | 4.7 K ohm |
| R20 | Resistor | 10M ohm |
| D1 | Bridge | 1.5A, 600V |
| D2 | Transistor | MBS4992 |
| D3, D4 | Diacs | 32V |
| D5 | Diode | 0.5A, 600V |
| D6-D9, D18 | Diodes | 0.5A, 400V |
| D10-D13 ,D16 ,D17 | Diodes (switching) | 75V, 0.45A |
| D14, D15 | Diodes | 0.5W, 18V Zener |
| DS1 | Fluorescent Miniature Lamp | 2O inches |
| F1 | Fuse | 4A, 125V |
| F2 | Thermal protector | |
| TR1 | Opto/triac | IS608-24 |
| L1 | Inductor | 1.0 MH |
| L2 | Inductor | 680 UH |
| L3 | Inductor | 1.9 MH |
| L4 | Choke | CMN MODE |
| Q1, Q2 | Transistors | NFET, IRFU224 |
| Q3, Q4 | Transistors | PNP, PMST3906 |
| T1 | Transformer | 130C |
| RV1 | MOV | 150VAC, 1200A |

There has thus been shown and described a pair of inverter disabling circuits which provides lamp and circuit component protection. The disabling circuits do not require tight control of circuit component tolerances.

While there have been shown and described what are at present considered to be the preferred embodiments of the invention, it will be apparent to those skilled in the art that various changes and modifications can be made herein without departing from the scope of the invention.

What is claimed is:

1. A ballast for a discharge lamp having a pair of cathodes wherein said discharge lamp is characterized by a lamp voltage waveform having a DC voltage component when said lamp approaches end-of-line upon depletion of emissive material on one of said cathodes, said ballast comprising:

a pair of AC input terminals for receiving an AC signal from an AC power supply;

DC power supply means coupled to said AC input terminals;

inverter means coupled to said DC power supply means and having an output;

load means coupled to said output of said inverter means comprising a tank circuit having a near-resonant mode condition and a resonant mode condition;

first detecting means for detecting an increase in said DC voltage component having an input for coupling to said discharge lamp, said first detecting means comprising an integration network; and disabling means coupled to the output of said first detecting means for disabling said inverter in response to at least said increase in said DC component.

2. The ballast of claim 1 wherein said tank circuit includes magnetic means having an inductive tank winding and wherein said ballast further includes second detecting means having an input coupled to said magnetic means for detecting at least said resonant mode condition of said tank circuit, said disabling means further disables said inverter in response to said resonant mode condition.

3. The ballast of claim 2 wherein said second detecting means also detects said near-resonant mode condition.

4. The ballast of claim 1 wherein said first detecting means includes a full wave bridge rectifier and a RC integration network.

5. The ballast of claim 1 wherein said means for disabling said inverter includes an optical isolator.

6. A ballast for a discharge lamp having a pair of cathodes wherein said discharge lamp is characterized by a lamp voltage waveform having a DC voltage component when said lamp approaches end-of-life upon depletion of emissive material on one of said cathodes, said ballast comprising:

a pair of AC input terminals for receiving an AC signal from an AC power supply;

DC power supply means coupled to said AC input terminals;

inverter means coupled to said DC power supply means and having an output;

load means coupled to said output of said inverter means comprising a tank circuit having a near-resonant mode condition, said tank circuit including magnetic means having an inductive tank winding;

first detecting means having an input coupled to said magnetic means for detecting said near-resonant mode condition of said tank circuit; and disabling means coupled to the output of said first detecting means for disabling said inverter in response to said near-resonant mode condition.

7. The ballast of claim 6 wherein said ballast further includes second detecting means having an input coupled to said discharge lamp for detecting an increase in said DC voltage component, said disabling means said inverter in response to said increase in said DC voltage component, said second detecting means comprising an integration network.

8. The ballast of claim 7 wherein said second detecting means includes a full wave bridge rectifier and a RC integration network.

9. The ballast of claim 6 wherein said means for disabling said inverter includes an optical isolator.

10. An arrangement comprising:

a pair of AC input terminals for receiving an AC signal from an AC power supply;

DC power supply means coupled to said AC input terminals;

inverter means coupled to said DC power supply means including a pair of semiconductor switches and means for driving said semiconductor switches;

load means coupled to the output of said inverter means comprising a tank circuit having a resonant mode condition and a discharge lamp having a pair of cathodes, said tank circuit including magnetic means having a primary inductance, said discharge lamp characterized by a lamp voltage waveform having a DC voltage component when said lamp approaches cad-of-life upon depletion of emissive material on one of said cathodes;

first detecting means having an input coupled to said magnetic means for detecting said resonant mode condition of said tank circuit;

second detecting means having an input coupled to said discharge lamp for detecting an increase in said DC voltage component lamp, said second detecting means comprising an integration network; and means coupled to the outputs of said first and second detecting means for disabling said inverter in response to said first and second detecting means.

* * * * *